US006196233B1

(12) United States Patent
Anastasio

(10) Patent No.: US 6,196,233 B1
(45) Date of Patent: Mar. 6, 2001

(54) GOLF TEE SHAPED CIGAR PUNCH AND CUTTER

(76) Inventor: Thomas R. Anastasio, 29 Wheeler Rd., Monroe, CT (US) 06468

( * ) Notice: Subject to any disclaimer, the term of this patent is extended or adjusted under 35 U.S.C. 154(b) by 0 days.

(21) Appl. No.: 09/221,900

(22) Filed: Dec. 28, 1998

(51) Int. Cl.[7] ..... A24F 13/24; A24F 13/20

(52) U.S. Cl. ..... 131/255; 131/248; 131/253; 131/254

(58) Field of Search ..... 131/253, 254, 131/255, 248; 30/111, 112, 113, 109; D27/195, 193, 194

(56) References Cited

U.S. PATENT DOCUMENTS

D. 388,532 12/1997 Wander .

5,862,808 * 1/1999 Albarello ..... 131/255

* cited by examiner

*Primary Examiner*—Stanley S. Silverman
*Assistant Examiner*—Dionne A. Walls
(74) *Attorney, Agent, or Firm*—Fattibene & Fattibene; Paul A. Fattibene; Arthur T. Fattibene

(57) ABSTRACT

A golf tee shaped punch and cutter having a plurality of different shaped chambers formed within a tapered body portion with a cutter assembly placed therein. The tapered body portion forms a narrow punch end and a wide cutter end having a cap removably placed thereon. A circular cutter blade is exposed upon removing the cap. Coaxially positioned within the circular cutter blade is a spring biased rod that helps to remove a plug of tobacco once cut. A duel taper helps to measure or guage the depth the punch is inserted into the end of the cigar. The present invention conveniently permits punching and cutting the end of a cigar with a single, easily utilized, and commercially attractive golf tee shaped device.

9 Claims, 2 Drawing Sheets

GOLF TEE SHAPED CIGAR PUNCH AND CUTTER

FIELD OF THE INVENTION

The invention relates generally to a device used with a cigar, and more particularly to a device used to punch and cut the end of a cigar prior to being smoked.

BACKGROUND OF THE INVENTION

Cigar smoking is a popular activity. The number of cigar smokers has increased dramatically over the years. The cigar market has grown along with the market for various devices used with cigars. Generally, before smoking some cigars, many individuals prefer to punch a hole in one end and cut the end of the cigar. There are many separate devices, such as a punch, that have been used to pierce the end of the cigar, as well as many separate devices that have been used to cut the end of the cigar, such as a cutter. One such ornamental design of a cigar perforator is disclosed in U.S. Pat. No. DES 388,532 entitled "Cigar Perforator" and issuing to Wander on Dec. 30, 1997. Many of these cutters are of the guillotine type that simply make a cut perpendicular to the longitudinal length of the cigar at one end. Separate circular cutters have also been used on cigars. However, the circular plug of tobacco often is difficult to remove from the circular cutter. Therefore, there is a need for an improved cigar punch and cutter that can perform the punching and cutting of the end of a cigar with a single device, as well being safe to use with some consumer appeal.

SUMMARY OF THE INVENTION

The present invention is a golf tee shaped cigar punch and cutter combination. A generally golf tee shaped punch and cutter has a pointed end designed to punch the end of a cigar and the other end having a cutter covered by a removable cap. Within a tapered body portion and covered by the removal cap is a stationary circular cutter blade. A rod is placed within the bore of the circular cutter blade within the tapered body and biased upward by a spring through the bore of the circular cutter blade.

Accordingly, it is an object of the present invention to provide a punch and cutter for a cigar in a single device.

It is a further object of the present invention to provide a cigar punch and cutter in a golf tee shape.

It is an advantage of the present invention that a tobacco plug can easily be removed from the circular cutter blade.

It is a further advantage of the present invention that it is relatively inexpensive to manufacture.

It is a feature of the present invention that a rod is biased within the bore of the circular cutter blade.

It is another feature of the present invention that the punch end is tapered and sized in relation to the circular cutter blade diameter.

These and other objects, advantages, and features will become readily apparent in view of the following detailed description.

DETAILED DESCRIPTION OF THE PREFERRED EMBODIMENTS

Figure 1:
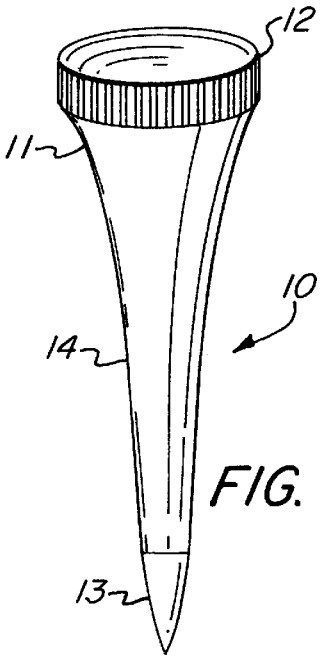
FIG. 1 is a perspective view of the present invention in assembled form.

FIG. 1 is a perspective view illustrating the present invention. A golf tee shaped punch and cutter assembly 10 has a wide cutter end 11 and a narrower punch end 13 which forms the tapered body portion 14. A cap 12 is removably placed on the wide cutter end 11.

Figure 2:
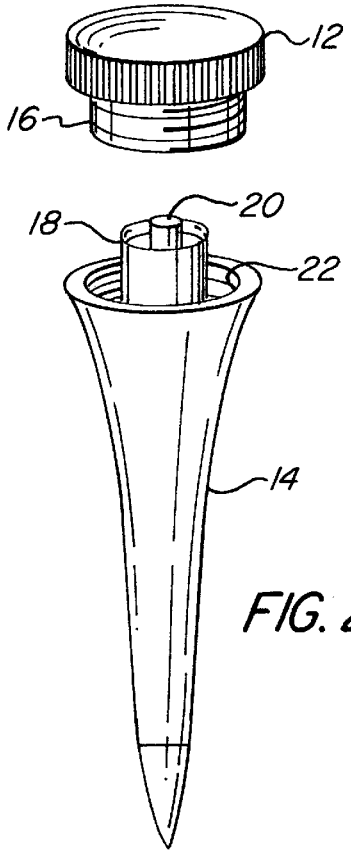
FIG. 2 is a perspective view illustrating removal of the cap exposing the cutter blade.

FIG. 2 illustrates the present invention with the cap 12 removed. The cap 12 is preferably threaded by male threads 16 onto the tapered body portion 14. The male threads 16 mate with female threads 22 in the interior of the tapered body portion 14. Upon removal of the cap 12, a circular cutter blade 18 is exposed. The circular or cylindrical cutter blade 18 has a bore therein. Rod or pin 20 extends coaxially within the cutter blade 18.

Figure 3A:
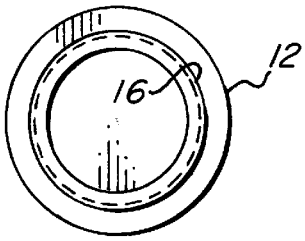
FIG. 3A is a plan view illustrating the cap interior.
Figure 3B:
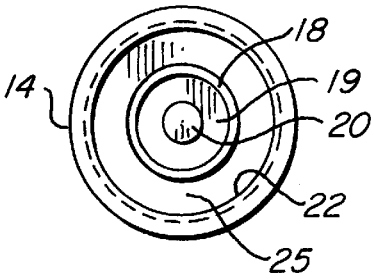
FIG. 3B is a plan view illustrating the interior of the body portion.

FIGS. 3A and 3B illustrate the interior of the cap 12 and the tapered body portion 14. In FIG. 3A, male threads 16 are utilized to fasten the cap 12 onto the tapered body portion 14. FIG. 3B illustrates in a general way the various areas in the tapered body portion 14. Beginning at the center, rod 20 is centrally located within the cutter bore 19 of the circular cutter blade 18. A cutter chamber 25 is coaxially formed between the cutter blade 18 and female thread area 22.

Figure 4:
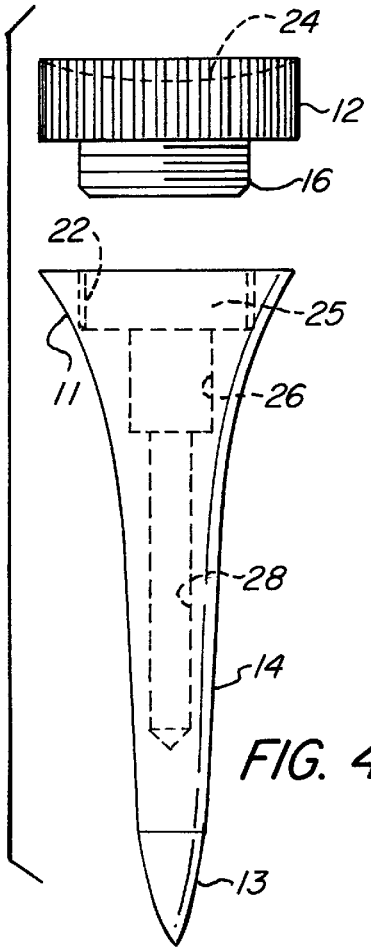
FIG. 4 is an elevational view illustrating the various chambers in the body portion without the cutter assembly.

FIG. 4 illustrates the various chambers formed within tapered body portion 14. Within the tapered body portion 14 is a spring chamber 28. A plug chamber 26 having a diameter greater than the spring chamber 28 is coaxially formed within the tapered body portion 14. A cutter chamber 25, having a diameter greater than the plug chamber 26 is coaxially formed within the wide cutter end 11 of the tapered body portion 14. Accordingly, a series of chambers 25, 26, and 28 are coaxially formed of varying diameters within the tapered body portion 14. Cap 12 is also illustrated with a concave depression 24 formed therein. The concave depression 24 further simulates a golf tee shape.

Figure 5:
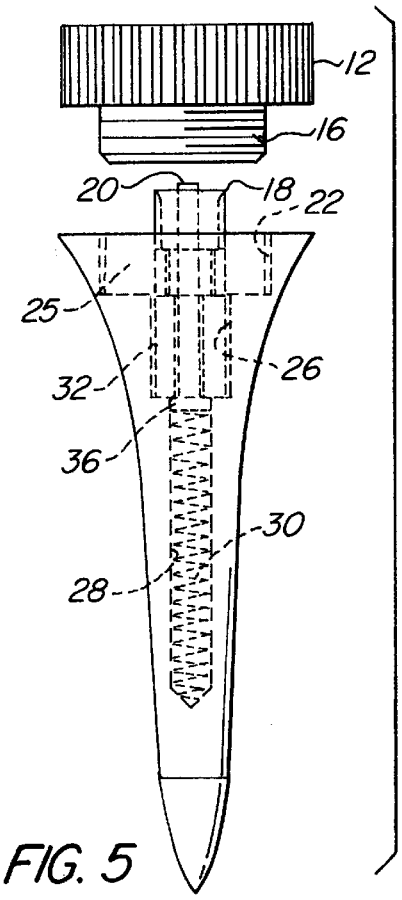
FIG. 5 is an elevational view illustrating the cutter assembly within the body portion.

FIG. 5 illustrates the present invention with the cutter assembly inserted into the tapered body portion 14. A spring 30 is placed within the spring chamber 28. A plug 32 is placed within the plug chamber 26. A cutter blade 18 is threaded onto the plug 32 and positioned within the cutter chamber 25. Rod 20 extends through the plug 32 and cutter blade 18. Rod 20 has a rod head 36, biased by the spring 30, positioned adjacent one end of the plug 32.

Figure 6:
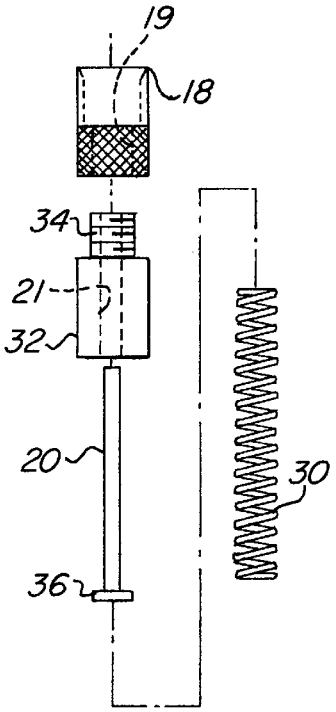
FIG. 6 is a exploded view of the cutter assembly.

FIG. 6 more clearly illustrates the cutter assembly. In operation, the spring 30 exerts a force adjacent the rod head 36 forcing the rod 20 through plug bore 21 within plug 32 and up through cutter bore 19 within cutter blade 18. The cutter blade 18 is threaded onto plug threads 34.

Referring to FIGS. 5 and 6, the operation of the cutter assembly can readily be appreciated. The plug 32 is press-fit or threaded into the plug chamber 26. Spring 30 normally biases the rod 20 upward through plug bore 21 and cutter bore 19. Rod head 36 has a diameter larger than the plug bore 21, preventing spring 30 from forcing rod 20 through the plug bore 21. The cutter blade 18 is threaded onto the plug threads 34, permitting easy removal should the cutter blade 18 become dull or damaged. The end of rod 20 extending through the cutter bore 19 and is preferably dimensioned so that the end is flush or nearly equal with the top surface of the cutter blade 18. However, the end of rod 20 may extend slightly above the surface of cutter blade 18, as illustrated in FIG. 5, or slightly below the surface of the cutter blade 18.

Figure 7:
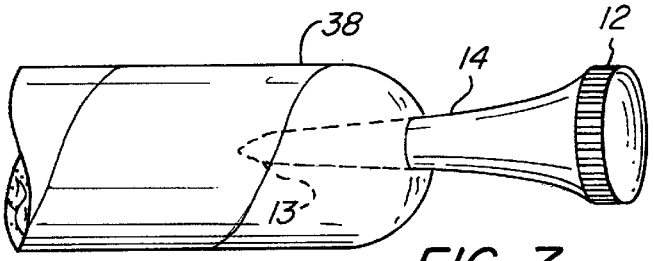
FIG. 7 is a drawing illustrating the punching of a cigar with one end of the present invention.
Figure 9:
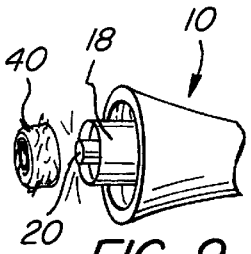
FIG. 9 is a partial drawing illustrating removal of a tobacco plug from the cutter of the present invention.
Figure 8:
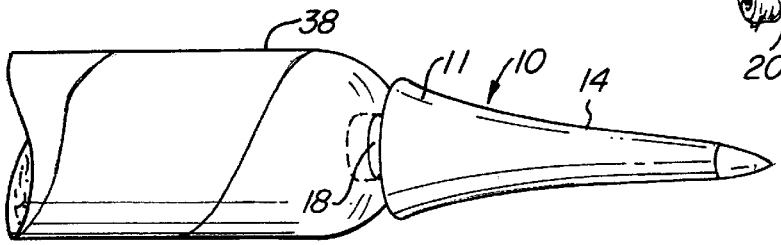
FIG. 8 is a drawing illustrating the cutting of a cigar with the other end of the present invention.

FIGS. 7, 8 and 9 illustrate the use of the present invention with a cigar 38. In FIG. 7, the narrow punch end 13 of the tapered body portion 14 is used to punch a hole in one end of a cigar 38. Subsequently, cap 12 is removed from the wide cutter end 11 exposing the cutter blade 18. As illustrated in FIG. 8, the cutter blade 18 is pushed longitudinally into the cigar 38 coaxial with the hole punched by the narrow punch end 13, illustrated in FIG. 7. FIG. 9 illustrates the advantage of the biased rod 20 coaxially positioned within the bore of the cutter blade 18 so that the cut plug of tobacco 40 can easily and conveniently be removed from the circular cutter blade 18 due to the bias force on the rod.

Figure 10:
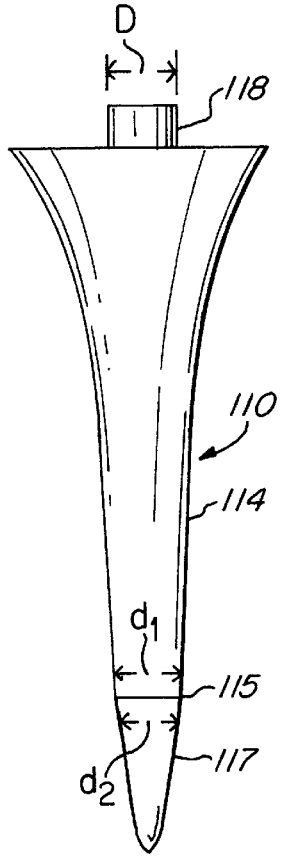
FIG. 10 is a diagram illustrating the dimensional relationship between the cutter blade diameter and the punch end of the tapered body portion.

FIG. 10 illustrates the dimensional relationship between a cutter blade and the tapered body portion of a preferred embodiment of the present invention. Cutter blade 118 has a diameter D. The tapered body portion 114 of the golf tee shaped cutter and punch 110 has a dual taper. Line 115 represents the change in taper between the tapered body portion 114 and the tapered point portion 117. The tapered point portion 117 has a taper that has a rate of taper greater than that of the tapered body portion 114. Diameter $d_1$represents the diameter of the tapered body portion 114 slightly past or above the change in taper line 115. Dimension $d_2$represents the diameter of the taper point portion slightly past or below the change in taper line 115. The relationship of the dimensions D and $d_1$ and $d_2$ is such that $d_1$ is greater than D, and $d_2$ is less than D. Accordingly, the tapered point portion 117 is made with a taper that is desirable for punching the end of a cigar such that the change in taper line 115 represents a guide or indication of the depth inserted into the cigar. As a result, the punched hole will not be larger than the diameter of the cutter 118. However, in some applications it may be desirable to make the diameter or lateral dimension at the taper line 115 greater than the diameter or dimension D of the cutter blade 118 so that the taper line 115 is always visible as a guide or gauge indicating the depth of insertion of the tapered point portion 117.

It should be appreciated that the present invention, combining a punch and cutter in a single device that has a desirable shape with consumer appeal has many advantages for cigar smokers. Additionally, with the present invention, a plug of tobacco is easily removed from the circular cutter blade. The shape of the present invention further helps to gauge the depth of insertion of the narrow punch end into a cigar, providing optimum punching and cutting of the cigar end. This facilitates smoking and enjoyment of the cigar.

While the preferred embodiment has been illustrated, it should be appreciated that various modifications may be made without departing from the spirit and scope of this invention.

What is claimed is:

1. A cigar punch and cutter comprising:

a tapered body portion having a punch end and a cutter end;

a cutter chamber formed in the cutter end of said tapered body portion;

a spring chamber formed in the tapered body portion;

a spring placed in said spring chamber;

a cutter blade placed in said cutter chamber, said cutter blade having a cutter bore therein;

a rod extending through the cutter bore and contacting said spring, said rod biased by said spring into the cutter bore; and a cap placed on the cutter end covering said cutter blade, whereby a cigar can be punched and cut.

2. A cigar punch and cutter as in claim 1 wherein:

said tapered body portion has a golf tee shape.

3. A cigar punch and cutter as in claim 2 further comprising:

a plug chamber placed between said cutter chamber and said spring chamber; and a plug fixedly placed within said plug chamber, said plug having a threaded portion thereon with said cutter blade threaded thereto, whereby said cutter can be removed.

4. A cigar punch and cutter as in claim 3 wherein:

the diameter of said cutter chamber is greater than the diameter of said plug chamber, and the diameter of said plug chamber is greater than the diameter of said spring chamber.

5. A cigar punch and cutter as in claim 3 wherein:

said cap has a concave surface and is threaded onto said tapered body portion.

6. A cigar punch and cutter comprising:

a tapered body portion with a dual taper having a punch end and a cutter end, the dual taper being separated by a taper line, said taper line formed a predetermined distance from the punch end;

a cutter chamber formed in the cutter end of said tapered body portion, said cutter chamber having a first diameter and male threads formed therein;

a plug chamber formed in said tapered body portion adjacent one end of said cutter chamber, said plug chamber having a second diameter, the second diameter being smaller than the first diameter;

a spring chamber formed in the tapered body portion adjacent one end of said plug chamber, said spring chamber having a third diameter, said third diameter being smaller than said second diameter;

a spring placed in said spring chamber;

a plug placed in said plug chamber, said plug having a plug bore therein;

a circular cutter blade threaded onto said plug and placed in said cutter chamber, said circular cutter blade having a cutter bore therein, the cutter bore having a fourth diameter;

a rod extending through the cutter bore and the plug bore, said rod having a head on one end with a fifth diameter and a flat other end opposite the head, the fifth diameter being greater than the diameter of the plug bore, the head positioned adjacent said plug and contacting said spring, the head normally biased by said spring contacting said plug, said rod having a longitudinal length sufficient to extend substantially into the cutter bore when normally biased by said spring towards and into the cutter bore of said circular cutter blade, whereby the cut plug of tobacco is removed from said circular cutter blade due to the bias force on said rod, and a cap having female threads formed thereon and having a concave top surface, the female threads adapted to mate with the male threads formed in said cutter chamber, said cap being threaded onto the cutter end covering said cutter blade, whereby the cigar can be punched and cut with a single device.

7. A cigar punch and cutter as in claim 6 wherein:

the diameter of the tapered body portion at the taper line is substantially the same as the diameter of said cutter blade.

8. A cigar punch and cutter as in claim 6 wherein:

the diameter of the tapered body portion at the taper line is greater than the diameter of said cutter blade.

9. A cigar punch and cutter comprising:

a tapered body portion (14) having a shape of a golf tee and a punch end (13) and a cutter end (11);

a cap (12) removably placed on the cutter end (11) of said tapered body portion (14);

a spring chamber (28) formed within said tapered body portion (14);

a cutter blade (18) having a cutter bore (19) placed within the cutter end (11) of said tapered body portion (14);

a rod (20) placed within said spring chamber (28) and extending coaxially within the cutter bore (19) of said cutter blade (18); and a spring (30) placed within said spring chamber (28), wherein said spring (30) exerts a force adjacent said rod (20) forcing said rod (20) through the cuter bore (19) within said cutter blade (18) and said rod (20) is dimensioned so that an end of said rod (20) is flush with a top surface of said cutter blade (18) when normally biased through the cutter bore (19) by said spring (30), whereby a cut plug of tobacco (40) can be removed from said cutter blade (18) due to a bias force on said rod (20).

* * * * *